United States Patent [19]

Anderson et al.

[11] 4,171,188

[45] Oct. 16, 1979

[54] ROTARY AIR COMPRESSORS WITH INTAKE VALVE CONTROL AND LUBRICATION SYSTEM

[75] Inventors: Donald F. Anderson; Harold J. Albright, both of Franklin, Pa.

[73] Assignee: Chicago Pneumatic Tool Company, New York, N.Y.

[21] Appl. No.: 893,706

[22] Filed: Apr. 5, 1978

Related U.S. Application Data

[63] Continuation of Ser. No. 711,399, Aug. 3, 1976, abandoned.

[51] Int. Cl.[2] ..... F04B 49/02

[52] U.S. Cl. ..... 417/282; 417/295; 418/87

[58] Field of Search ..... 417/282, 295, 300; 418/97, 98, 99, 100

[56] References Cited

U.S. PATENT DOCUMENTS

| | | | |
|---|---|---|---|
| 3,367,562 | 2/1968 | Persson et al. | 417/295 |
| 3,482,768 | 12/1969 | Cirrincione et al. | 417/295 X |
| 3,860,363 | 1/1975 | Silvern et al. | 417/295 X |
| 3,873,239 | 3/1975 | Jamieson | 417/295 X |
| 3,961,862 | 6/1976 | Edstrom et al. | 417/282 |

*Primary Examiner*—Carlton R. Croyle
*Assistant Examiner*—Leonard E. Smith

[57] ABSTRACT

A rotary air compressor system of the screw type having an intake valve designed to have a closed condition at start-up, and having intake valve controls for effecting an initial lubrication and cooling of the compressor at start-up and a reduced strain on the motor.

1 Claim, 1 Drawing Figure

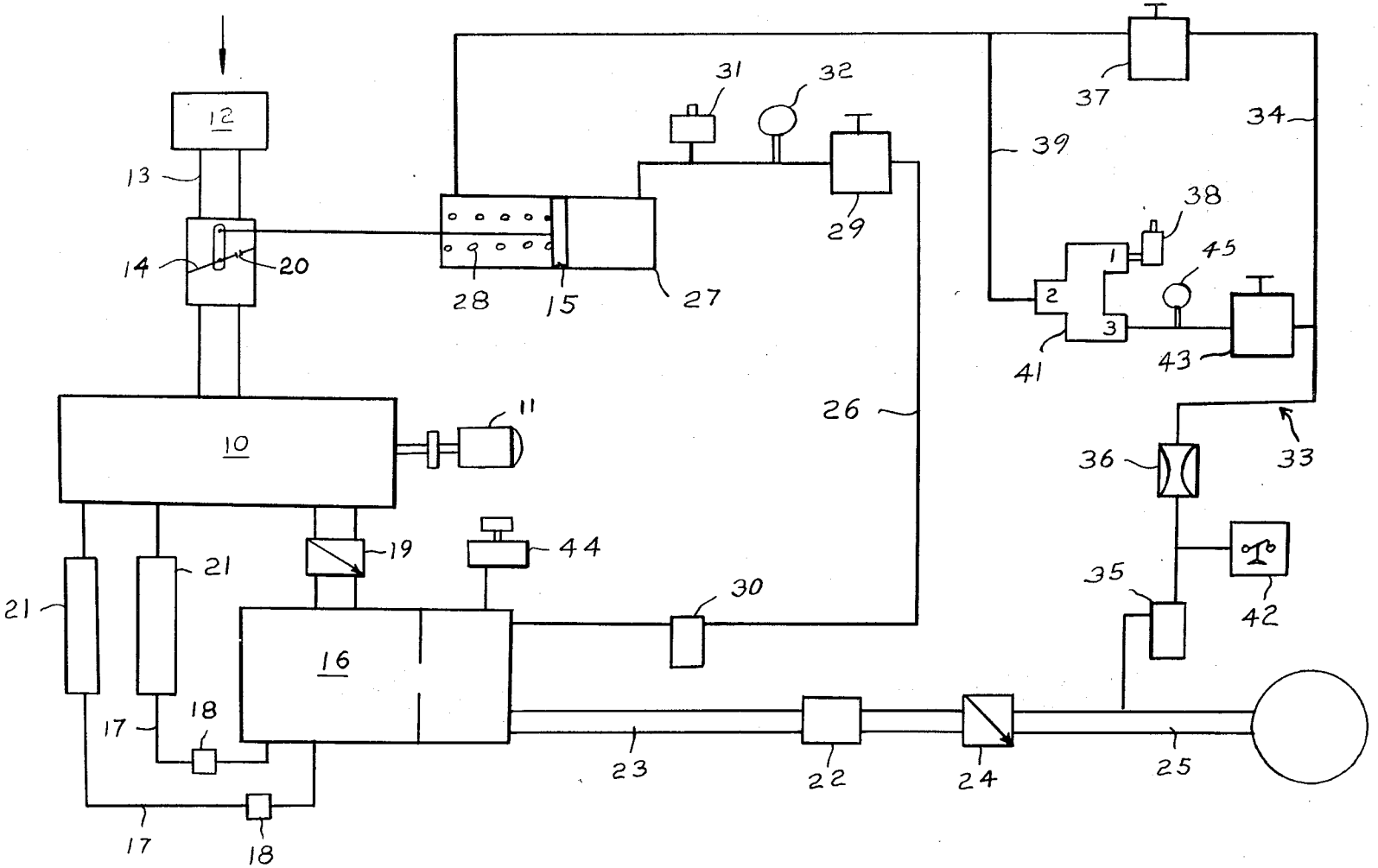
10
11
12
13
14
15
16
17
18
19
20
21
22
23
24
25
26
27
28
29
30
31
32
33
34
35
36
37
38
39
41
42
43
44
45
1
2
3

ROTARY AIR COMPRESSORS WITH INTAKE VALVE CONTROL AND LUBRICATION SYSTEM

BACKGROUND OF THE INVENTION

This application is a continuation of our pending application, Ser. No. 711,399, filed Aug. 3, 1976, now abandoned.

This invention is directed to providing improvements in rotary air compressors. More particularly, it is directed to providing a rotary air compressor system of the screw type with an advantageous intake valve control system in which the intake valve has a closed condition at start-up.

Conventional air compressors of the rotary type are equipped with the usual oil feed system which responds to pressure developing in the air receiver after start-up to feed lubricating cooling oil to the compressor. However, there is a need before the usual pressurized oil feed for a more immediate oil flow to the compressor at start-up to further insure against heat damage to the compressor. It is also desired at start-up of the compressor to reduce the usual start-up strain on the motor to a minimum.

Accordingly, a primary object of this invention is to provide an arrangement in a rotary compressor air system directed to attaining the foregoing ends.

In accordance with the invention, there is provided a rotary air compressor system including a motor driven rotary air compressor, an air inlet passage to the compressor, an air receiver connected with the compressor having an oil sump at its bottom, an oil conduit connecting the sump with the compressor, a butterfly intake valve in the inlet passage controlling inlet flow into the compressor having a normally closed condition and provided with a small hole for admitting a restricted flow of inlet air to the compressor while the intake valve is closed, the compressor being adapted upon rotating at start-up to create a suction effect over the oil conduit and to cause a partial vacuum condition to develop in the compressor because of the closed condition of the intake valve whereby a strong suction force developing in the compressor draws oil from the sump over the oil conduit into the compressor.

BRIEF DESCRIPTION OF THE DRAWING

The single FIGURE of the accompanying drawing is a schematic diagram of a rotary air compressor system embodying the invention.

DESCRIPTION OF PREFERRED EMBODIMENT

The compressor system includes a rotary air end or compressor 10 of a conventional screw type driven by an electric motor 11.

Intake air passes through a filter 12 to an inlet passage 13. After the motor is energized the compressor starts up or begins rotating and draws in inlet air in restricted volume through an orifice or small hole 20 in a closed intake valve 14. The intake valve has a normally closed condition at start-up under the bias of a spring loaded valve actuating piston 15.

The closed condition of the intake valve and the restricted air intake as the compressor starts up develops a partial vacuum in the compressor at this time. This is of advantage in that it results in a temporary light loading of the compressor and, accordingly, enables the motor to overcome the minimum strain the initial inertia of the compressor at start-up.

The vacuum is of further advantage in that it supplements the suction of the compressor as the latter starts rotating to draw into the compressor cooling lubricating oil from the usual oil sump at the bottom of the usual receiver 16. This oil is drawn in over the usual feed lines 17 connecting the sump with the compressor. Conventional solenoid oil feed shut-off valves 18 having a normally closed condition in the oil feed lines are adapted to open simultaneously with the energization of the motor.

By means of this arrangement, an initial lubricated and cool condition of the compressor is immediately provided at start-up. This occurs before the receiver can in the usual manner be pressurized with air from the compressor to force oil from the sump over the feed lines to the compressor.

The restricted intake air flow entering the compressor mingles with the oil being drawn into the compressor and the compressed air-oil mixture is discharged through a check valve 19 to the receiver. The oil settles by gravity out of the receiver air to the sump below for recirculation to the compressor. Suitable oil coolers 21 are connected in the oil feed lines.

A minimum pressure valve 22 initially prevents flow of receiver air from an outlet passage 23 through a check valve 24 to a demand service line 25. This enables receiver air pressure to rapidly build up to pressurize oil from the sump to provide the fuller flow of oil needed to cool and lubricate the compressor during the time of its accelerated operation after start-up.

The closed condition of the intake valve 14 at start-up is designed to be brief, and it is intended to progressively open so as to allow the compressor to progress from its lightly loaded condition to a fully loaded condition.

As pressure progressively builds up in the receiver, the intake valve is caused to be progressively opened by the piston 15. This occurs as pressurized air bleeds from the receiver over a control line 26 to the butt end of the piston cylinder 27 and progressively overcomes the bias of the piston spring 28. The pressure required to do this is less than that required to open the minimum pressure valve 22. Accordingly, the latter valve does not open to allow receiver air flow to the service line 25 until receiver pressure has built up sufficiently to effect a forced injection of sump oil over the feed lines 17 into the compressor, and until the intake valve has first fully opened to fully load the compressor.

The pressure to be applied over the control line 26 to the piston in an opening direction of the intake valve is controlled so as not to exceed a precise value as determined by a pressure regulator 29 and an adjustable venting orifice 31, both connected in the control line. A slight pressure gage 32 aids the operator in this respect. A filter 30 serves to clean residue oil from the air flowing over the control line.

To enable the intake valve to modulate inlet air flow to the compressor to match the demands on the service line, and to enable the intake valve to close so as to shut off intake air to the compressor when service line pressure rises above a predetermined maximum, conduit means 33 associating the spring side of the piston cylinder 27 with the service line 25 is provided.

The conduit means includes a loop line 34 connected at one end to the service line and connected at its other end to the spring side of the piston cylinder. A filter 35 serves to clean residue oil from the air flowing into the loop line. An orifice 36 serves to bleed the air from the service line over the loop line to a pressure regulator 37.

When the service line pressure rises to the pressure setting of regulator 37, the latter opens to allow service line air to be applied over the loop line to move the piston in a closing direction to begin modulation of intake air to the compressor. The pressure of air passing over the loop line to the piston cylinder is controlled so as not to exceed a precise value as determined by the regulator 37 and an associated adjustable venting orifice 38.

A by-pass line 39 connected in the loop line is designed to by pass the regulator 37 when service line pressure reaches a predetermined maximum, so as to pass service line air directly to the piston cylinder to cause the intake valve to close and unload the compressor.

Flow through the by-pass line is controlled by a 3-way solenoid control valve 41. A differential pressure switch 42 responsive to pressure changes in the service line controls operation of valve 41. The switch has a low pressure setting corresponding to that required to open regulator 37; and has a higher or maximum setting to effect closing of the intake valve.

At start-up and when service line pressure is below the low setting of switch 42, connections 1 and 2 of valve 41 communicate the spring side of the piston cylinder over the by-pass line 39 with the venting orifice 38 so as to vent trapped air from the cylinder to enable the piston to move in an opening direction of the intake valve.

When service line pressure reaches the low setting of switch 42, which setting corresponds to the setting of regulator 37, control valve 41 shifts to its 3 and 1 connections. This communicates the loop line 34 over the by-pass line with the venting orifice to effect the precise controlled pressure flow through the regulator 37 to the piston cylinder as modulation begins.

When the service line pressure rises above the maximum setting of switch 42, valve 41 shifts to its 3 and 2 connections. This causes a direct flow of service line air over the by-pass line to the spring side of the piston cylinder, forcing the piston to close the intake valve, thus unloading the compressor. A suitable pressure regulator 43 is connected in the by-pass line upstream of switch 42 to obtain a controlled pressure flow of receiver air directly to the piston cylinder. A sight pressure gauge 45 is connected in the by-pass line. As the pressure switch 42 responds to the increased pressure rise, the usual solenoid venting valve 44 automatically opens to blow down the receiver.

After the receiver has been blown down and the service line pressure again drops below the maximum setting of switch 42, control valve 41 reshifts to its 1 and 3 connections, and modulation resumes. Also the venting valve 44 automatically closes in conventional manner.

Should the compressor be finally stopped upon deenergization of the motor, venting valve 44 re-opens to blow down the receiver; control valve 41 shifts back to its 2 and 1 connections to bleed off trapped air from the spring side of the piston cylinder; and oil feed valves 18 automatically close in conventional manner to avoid oil flooding the compressor under pressure of receiver air before the receiver has been adequately blown down.

We claim:

1. A rotary air compressor system including a motor driven rotary air compressor, an air inlet passage to the compressor, an air receiver connected with the compressor having an oil sump at its bottom, an oil conduit connecting the sump with the compressor, a butterfly intake valve in the inlet passage controlling inlet flow into the compressor having a normally closed condition and provided with a small hole for admitting a restricted flow of inlet air to the compressor while the intake valve is closed, the compressor upon rotating at start-up creating a suction effect over the oil conduit and causing a partial vacuum condition to develop in the compressor because of the closed condition of the intake valve whereby a strong suction force developing in the compressor draws oil from the sump over the oil conduit into the compressor, a piston attached to the intake valve, a biased spring acting upon the piston to draw the valve to a closed condition in the inlet passage, a minimum pressure valve arranged in a discharge passage connecting the receiver with a demand service line, said minimum pressure valve maintaining said discharge passage closed until a predetermined pressure rises in the receiver, said piston being operable in a cylinder, a butt end of the cylinder being connected by a first control conduit with the receiver to pass receiver air to the cylinder to move the piston against the bias of the spring to open the intake valve, the other end of the cylinder being connected by a second conduit to the service line to receive pressure air from the service line to supplement the bias of the spring to move the piston to draw the intake valve in a closing direction, pressure regulating means being connected in each of the first and second conduits, and a by-pass line is connected in the second conduit to pass service line air around the pressure regulating means and directly to the piston cylinder to supplement the bias of the spring to force the piston to close the intake valve.

* * * * *